US010398172B2

(12) United States Patent
Batista

(10) Patent No.: US 10,398,172 B2
(45) Date of Patent: Sep. 3, 2019

(54) CONTAINER HAVING A HEATER FOR AN AEROSOL-GENERATING DEVICE, AND AEROSOL-GENERATING DEVICE

(71) Applicant: Philip Morris Products S.A., Neuchatel (CH)

(72) Inventor: Rui Nuno Batista, Morges (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 156 days.

(21) Appl. No.: 15/306,801

(22) PCT Filed: Apr. 24, 2015

(86) PCT No.: PCT/EP2015/058908
§ 371 (c)(1),
(2) Date: Oct. 26, 2016

(87) PCT Pub. No.: WO2015/165812
PCT Pub. Date: Nov. 5, 2015

(65) Prior Publication Data

US 2017/0049154 A1 Feb. 23, 2017

(30) Foreign Application Priority Data

Apr. 30, 2014 (EP) ..... 14166746

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
CPC ..... H05B 3/0014; H05B 3/06; H05B 1/0244; H05B 2203/021; A24F 47/008
(Continued)

(56) References Cited

U.S. PATENT DOCUMENTS 8,794,231 B2 * 8/2014 Thorens ..... A24F 47/008 128/202.21
8,910,640 B2 * 12/2014 Sears ..... F22B 1/28 131/273

(Continued)

FOREIGN PATENT DOCUMENTS

RU 103 281 U1 4/2011
WO WO 2013/045582 A2 4/2013

(Continued)

OTHER PUBLICATIONS

Combined Office Action and Search Report dated Oct. 8, 2018 in Russian Patent Application No. 2016146532, 8 pages (submitting English translation only).

(Continued)

*Primary Examiner* — Jimmy Chou
(74) *Attorney, Agent, or Firm* — Oblon, McClelland, Maier & Neustadt, L.L.P.

(57) ABSTRACT

There is provided a container for an aerosol-generating substrate for use in an electrically heated aerosol-generating device, including a casing having at least one air inlet and at least one air outlet; a tubular liquid retention element configured to sorb an aerosol-generating substrate; and an air permeable capillary wick membrane including at least one electrical heater and being provided on an end face of the retention element, such that an airflow pathway is provided from the at least one air inlet through a portion of the membrane to the at least one air outlet. There is also provided an electrically heated aerosol-generating device including a power supply; a cavity configured to receive a container; electrical contacts connected to the power supply and configured to couple the power supply to a heater; and an air inlet configured to be coupled to the at least one air inlet.

14 Claims, 7 Drawing Sheets

(58) Field of Classification Search
USPC ..... 219/482, 494
See application file for complete search history.

(56) References Cited

U.S. PATENT DOCUMENTS

| | | | | |
|---|---|---|---|---|
| 8,997,753 | B2 * | 4/2015 | Li | H01C 17/00 131/273 |
| 9,848,644 | B2 * | 12/2017 | Plunkett | A24F 47/008 |
| 9,993,023 | B2 * | 6/2018 | Tucker | A24F 47/008 |
| 10,143,234 | B2 * | 12/2018 | Hon | H05B 3/22 |
| 2008/0092912 | A1 * | 4/2008 | Robinson | A24F 47/008 131/200 |
| 2009/0272379 | A1 * | 11/2009 | Thorens | A24F 47/008 128/202.21 |
| 2011/0011396 | A1 * | 1/2011 | Fang | A24F 47/008 128/202.21 |
| 2011/0094523 | A1 * | 4/2011 | Thorens | A24F 47/008 131/194 |
| 2011/0120482 | A1 * | 5/2011 | Brenneise | A24F 47/008 131/328 |
| 2011/0155153 | A1 * | 6/2011 | Thorens | H05B 3/58 131/329 |
| 2011/0265806 | A1 * | 11/2011 | Alarcon | A24F 47/008 131/273 |
| 2011/0277760 | A1 | 11/2011 | Terry et al. | |
| 2012/0111347 | A1 * | 5/2012 | Hon | A24F 47/008 131/329 |
| 2013/0319435 | A1 * | 12/2013 | Flick | A24F 47/008 131/328 |
| 2014/0060555 | A1 * | 3/2014 | Chang | A24F 47/008 131/329 |
| 2014/0246016 | A1 | 9/2014 | Terry et al. | |
| 2014/0246017 | A1 | 9/2014 | Terry et al. | |
| 2014/0246019 | A1 | 9/2014 | Terry et al. | |
| 2014/0251326 | A1 | 9/2014 | Terry et al. | |
| 2014/0261491 | A1 * | 9/2014 | Hawes | A24F 47/008 131/328 |
| 2014/0283855 | A1 * | 9/2014 | Hawes | A24F 47/008 131/328 |
| 2014/0299141 | A1 * | 10/2014 | Flick | H05B 1/0202 131/329 |
| 2014/0305454 | A1 * | 10/2014 | Rinker | A24F 47/008 131/329 |
| 2015/0027471 | A1 * | 1/2015 | Feldman | H05B 3/16 131/329 |
| 2015/0068542 | A1 * | 3/2015 | Chang | A24F 47/008 131/328 |
| 2015/0114411 | A1 * | 4/2015 | Buchberger | A61M 11/041 131/329 |
| 2015/0196058 | A1 * | 7/2015 | Lord | A24F 47/008 131/329 |
| 2015/0264979 | A1 * | 9/2015 | Thorens | H05B 3/58 392/395 |
| 2015/0327596 | A1 * | 11/2015 | Alarcon | A24F 47/008 131/328 |
| 2016/0029697 | A1 * | 2/2016 | Shafer | A24F 47/008 131/328 |
| 2016/0058073 | A1 * | 3/2016 | Chen | A24F 47/008 131/329 |
| 2016/0198772 | A1 * | 7/2016 | Thorens | A24F 47/008 131/329 |

FOREIGN PATENT DOCUMENTS

| | | |
|---|---|---|
| WO | WO 2013/083635 A1 | 6/2013 |
| WO | WO 2013/155645 | 10/2013 |

OTHER PUBLICATIONS

International Search Report and Written Opinion dated Jul. 8, 2015, in PCT/EP15/58908 filed Apr. 24, 2015.

Combined Office Action and Search Report dated Nov. 1, 2018 in Chinese Patent Application No. 201580022180.6 (with English translation), 16 pages.

Japanese Office Action with English translation dated Jun. 28, 2019 in corresponding Japanese Patent Application No. 2016-560890, (7 pages).

* cited by examiner

CONTAINER HAVING A HEATER FOR AN AEROSOL-GENERATING DEVICE, AND AEROSOL-GENERATING DEVICE

The present invention relates to containers for aerosol-generating systems that comprise a heater assembly that is suitable for vapourising a liquid. In particular, the invention relates to handheld aerosol-generating systems, such as electrically operated smoking systems.

Aerosol-generating systems comprising containers and an aerosol-generating devices are known. One such type of aerosol-generating system is an electrically operated smoking system. Handheld electrically operated smoking systems consisting of a device portion comprising a battery and control electronics, and a container or cartridge portion comprising a supply of aerosol-forming substrate, and an electrically operated vapouriser, are known. A cartridge comprising both a supply of aerosol-forming substrate and a vapouriser is sometimes referred to as a "cartomiser". The vapouriser typically comprises a coil of heater wire wound around an elongate wick soaked in liquid aerosol-forming substrate. The cartridge portion typically comprises not only the supply of aerosol-forming substrate and an electrically operated vapouriser, but also a mouthpiece, which the user sucks on in use to draw aerosol into their mouth.

However, this arrangement has the drawback that the cartridges are relatively expensive to produce. This is because manufacturing the wick and coil assembly is difficult. Also, the wick and coil assembly can suffer from gravitational effects meaning that it does not operate optimally in certain orientations. For example, the liquid comprising the aerosol-forming substrate held by the wick and/or a liquid retention material within the cartridge can shift within the cartridge, leading to a non-homogeneous distribution of the liquid within the wick and/or material.

Thus, it would be desirable to provide a container and aerosol-generating device which ameliorates the problems of the known containers and devices.

According to an aspect of the present invention, there is provided a container for a liquid aerosol-generating substrate for use in an electrically heated aerosol-generating device. The container comprises: a casing having at least one air inlet and at least one air outlet; a tubular liquid retention element, for sorbing a liquid aerosol-generating substrate; and an air permeable capillary wick membrane comprising at least one electrical heater. The membrane is provided on an end face of the tubular liquid retention element, such that an airflow pathway is provided from the at least one air inlet through a portion of the membrane to the at least one air outlet.

Advantageously, providing the electrical heater on a capillary wick membrane enables the aerosol-generating substrate to be vapourised more efficiently, because the configuration enables a large contact area between the heater and the liquid aerosol-generating substrate. In addition, the heater may be substantially flat allowing for simple manufacture. As used herein, "substantially flat" means formed in a single plane and not wrapped around or otherwise conformed to fit a curved or other non-planar shape. A substantially flat heater can more be easily handled during manufacture and provides for a robust construction.

As used herein, by "sorbed" it is meant that the liquid is adsorbed on the surface of the tubular liquid retention element, or absorbed in the tubular liquid retention element, or both adsorbed on and absorbed in the tubular liquid retention element.

The at least one electrical heater is preferably provided on the portion of the membrane within the airflow pathway. More preferably, the at least one electrical heater is provided wholly on the portion of the membrane within the airflow pathway. Providing the electrical heater wholly on the portion of the membrane within the airflow pathway may increase the efficiency of the aerosol-generating device because the liquid aerosol-generating substrate is wicked to the heater more efficiently.

The container preferably further comprises a tubular element provided within the tubular liquid retention element, and extending from the at least one air inlet towards the membrane. The tubular element is preferably substantially air impermeable. The tubular element is preferably configured to prevent the liquid aerosol-generating substrate from leaking into the airflow pathway. The longitudinal length of the tubular element may be equal to the longitudinal length of the tubular liquid retention element. Alternatively the length of the tubular element may be between about 50% and about 95% of the longitudinal length of the tubular liquid retention element.

In use, the membrane is provided at the downstream end of the tubular liquid retention element.

The container may further comprise a further tubular liquid retention element provided adjacent an end of the tubular liquid retention element such that membrane is provided between the tubular liquid retention elements. The further tubular liquid retention element may improve the reliability of the container when used in an aerosol-generating device, because any effects of the container being tilted at an angle from horizontal are mitigated.

The further tubular liquid retention element may comprise the same liquid aerosol-generating substrate as retained on the initial tubular liquid retention element, or alternatively may comprise a different liquid, such as a flavour liquid.

In addition, the container may comprise a further air permeable capillary wick membrane provided adjacent the at least one electrical heater, such that a laminate is formed with the at least one heater encapsulated within the membrane and the further membrane. Providing a laminate in this way may also improve the reliability of the container when used in an aerosol-generating device, because the capillary wick encapsulates the heater providing a more robust wick and heater combination. The further membrane may comprise a further electrical heater. As such, a laminate comprising a layer of membrane, a layer of heater, a layer of membrane and a layer of heater is provided.

The further membrane may be of the same material, or of a different material than the initial membrane. If the materials are different, the wicking properties of the materials are preferably different.

The further electrical heater is preferably electrically coupled to the at least one electrical heater.

In the embodiment comprising a further electrical heater, a yet further air permeable capillary wick membrane may be provided adjacent the further electrical heater, such that a laminate is formed with the further heater encapsulated within the further membrane and the yet further membrane. Preferably, this embodiment comprises the further tubular liquid retention element, the further liquid retention element being provided adjacent the membrane and heater laminate.

The or each electrical heating element preferably has an elongate cross-sectional profile. Providing an elongate cross-sectional profile increases the volume of liquid in contact with the heater, and thus the heater is more efficient. A conventional heater having a coil of wire as the heating element generally has a circular or oval cross-sectional shape, and a meniscus of liquid may only form at the sides of the wire. In comparison, the elongate cross-sectional profile of the present invention enables a meniscus of liquid to form both at the sides of the heater and on the top surface.

The elongate cross-sectional profile is preferably rectangular. A rectangular cross-sectional shape is easier to manufacture and thus reduces costs.

The or each heater preferably comprises two electrical contacts, the electrical contacts extending from the heater to an external surface of the casing. In a preferred embodiment, the electrical contacts extend to an external end surface of the casing. Where the electrical contacts extend to an external end surface of the casing, they are preferably provided at a first and a second respective radial distance from the longitudinal axis of the container. In doing so, the electrical contacts are more easily matched with electrical contacts in an aerosol-generating device.

The electrical resistance of the or each heater is preferably between 0.3 and 4 Ohms. More preferably, the electrical resistance of the or each heater is between 0.5 and 3 Ohms, and more preferably about 1 Ohm. The electrical resistance of the or each heater is preferably at least an order of magnitude, and more preferably at least two orders of magnitude, greater than the electrical resistance of the contact portions. This ensures that the heat generated by passing current through the heater element is localised to the heater. It is advantageous to have a low overall resistance for the heater if the system is powered by a battery. A low resistance, high current system allows for the delivery of high power to the heater. This allows the heater to reach the electrically conductive filaments to a desired temperature quickly.

The capillary wick membrane is preferably a high retention and release material. The material of the membrane is preferably a fibrous material, the fibres preferably being of alumina. In addition, or alternatively, the membrane material may comprise a cellulose fibrous mat.

According to a further aspect of the present invention, there is provided an electrically heated aerosol-generating device. The device comprises: a power supply; a cavity for receiving a container as described herein containing a liquid aerosol-generating substrate; electrical contacts connected to the power supply and configured to couple the power supply to the heater of a container; and an air inlet configured to be coupled to the at least one air inlet of a container when the container is received in the cavity.

The device preferably further comprises a housing, configured to house the components of the device. The at least one air inlet is preferably provided in a side wall of the housing, adjacent the cavity. More preferably, the at least one air inlet is provided in a side wall of the housing adjacent the end of the cavity. The at least one air inlet may be a plurality of air inlets provided circumscribing the circumference of the housing.

The container may comprise a mouthpiece provided at an end of the container, such that, in use, the user may inhale the generated aerosol.

As used herein, the term "longitudinal" refers to the direction between the proximal end and opposed distal end of the container, and refers to the direction between the proximal, or mouthpiece, end and the distal end of the aerosol-generating device.

The aerosol-forming substrate is preferably a substrate capable of releasing volatile compounds that can form an aerosol. The volatile compounds are released by heating the aerosol-forming substrate.

The aerosol-forming substrate may comprise both solid and liquid components.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavour compounds, which are released from the aerosol-forming substrate upon heating. The aerosol-forming substrate may comprise homogenised tobacco material.

The aerosol-forming substrate may alternatively comprise a non-tobacco-containing material. The aerosol-forming substrate may comprise homogenised plant-based material.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine.

The aerosol-forming substrate may comprise other additives and ingredients, such as flavou rants.

The aerosol-forming substrate preferably comprises nicotine and at least one aerosol-former. In a particularly preferred embodiment, the aerosol-former is glycerine.

The container is preferably filled with between about 150 mg and about 400 mg of aerosol-forming substrate, more preferably between about 200 mg and about 300 mg of aerosol-forming substrate, and in a preferred embodiment about 250 mg of aerosol-forming substrate.

The power supply may be a battery, and may be a rechargable battery configured for many cycles of charge and discharge. The battery may be a Lithium based battery, for example a Lithium-Cobalt, a Lithium-Iron-Phosphate, a Lithium Titanate or a Lithium-Polymer battery. The battery may alternatively be a Nickel-metal hydride battery or a Nickel cadmium battery. The battery capacity is preferably selected to allow for multiple uses by the user before requiring recharging. The capacity of the battery is preferably sufficient for a minimum of 20 uses by the user before recharging is required.

As an alternative, the power supply may be another form of charge storage device such as a capacitor. The power supply may require recharging and may have a capacity that allows for the storage of enough energy for one or more smoking experiences; for example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater assembly.

The aerosol-generating device preferably further comprises control electronics. The control electronics are preferably configured to supply, and regulate, power from the power supply to the at least one heater. Power may be supplied to the heater assembly continuously basis. The power may be supplied to the heater assembly in the form of pulses of electrical current.

The control electronics may comprise a microprocessor, which may be a programmable microprocessor. The control electronics may comprise further electronic components.

The aerosol-generating device may further comprise a temperature sensor adjacent the cavity for receiving the container. The temperature sensor is in communication with the control electronics to enable the control electronics to maintain the temperature at the operating temperature. The temperature sensor may be a thermocouple, or alternatively the at least one heater may be used to provide information relating to the temperature. In this alternative, the temperature dependent resistive properties of the at least one heater are known, and are used to determine the temperature of the at least one heater in a manner known to the skilled person.

The aerosol-generating device may comprise a puff detector in communication with the control electronics. The puff detector is preferably configured to detect when a user draws on the aerosol-generating device mouthpiece. The control electronics are preferably further configured to control power to the at least one heating element in dependence on the input from the puff detector.

The aerosol-generating device preferably further comprises a user input, such as a switch or button. This enables the user to turn the device on. The switch or button may initiate the aerosol generation or prepare the control electronics to await input from the puff detector.

The aerosol-generating device further comprises a housing comprising the cavity and other components. The housing of the aerosol-generating device is preferably elongate, such as an elongate cylinder having a circular cross-section. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably, the aerosol-generating system is portable. The aerosol-generating system may have a size comparable to a conventional cigar or cigarette. The smoking system may have a total length between approximately 30 mm and approximately 150 mm. The smoking system may have an external diameter between approximately 5 mm and approximately 30 mm.

The aerosol-generating device may comprise a further heater. The further heater may be provided in the cavity for receiving a container. The further heater is configured to receive power from the power supply. The further heater may enable the aerosol-generating substrate to reach an operating temperature more quickly.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1:
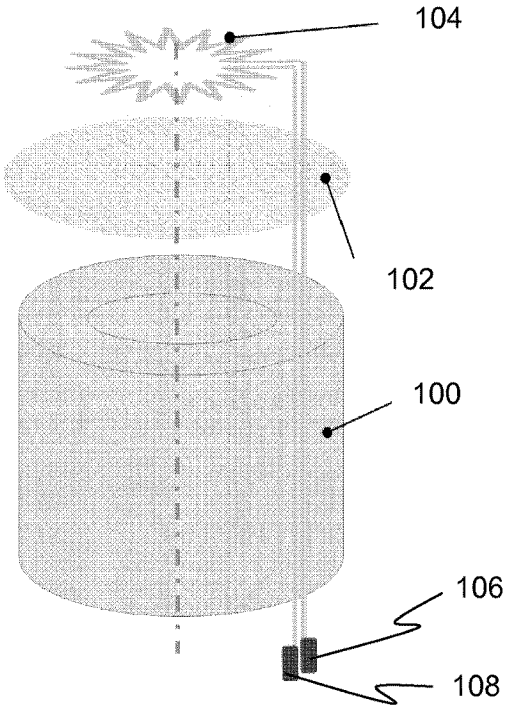
FIG. 1 shows an exploded view of the internal components of a container according to the present invention.

FIG. 1 shows an exploded view of the internal components of a container. The components of the container comprise a high retention release material in the form of a tubular element 100, a capillary wick membrane 102, and an electrical heating element 104 having electrical contacts 106 and 108. The tubular element 100 is configured to receive a liquid aerosol-generating substrate.

The high retention release material of the tubular element 100 may formed from, for example, Polyethylene-Polypropylene or Polyethyleneterephthalate compositions. Other suitable materials include various forms of glass matted fibers or other low-density foams (for instance, polyethylene, ethylene vinyl acetate (EVA), or natural cellulose-material sponges).

The high retention release material may comprise a first and second portion, where in the first portion of the material has different physical properties than the second portion. The different physical properties may be a higher or lower decomposition temperature, a higher or lower wicking capability, and a higher or lower absorption capacity, For example, if higher retention is desired, material having a pore diameter of greater than 12 microns may be used. In contrast, where transport of the liquid is desired, a pore size between 10-12 microns may be used. Where higher thermal stability or resistance is required, for example, when operating temperatures of between approximately 200° C. and 250° C. are used during operation, glass, alumina, stainless steel, silica, jute, flax, carbon fibre, and aramid (Kevlar) fibres may be used in the form of yarns, ropes, woven or unwoven mats, and fibre mats or felts. At temperatures up to 200° C., other materials such as combinations of Polyethylene, Polypropylene, and Polyethyleneterephthalate, as well as glass matted fibres or other low-density foams (for instance, polyethylene, ethylene vinyl acetate (EVA), or natural cellulose-material sponges).

The membrane 102 may be of a fibrous mat, such as a woven mat. The fibres may be of alumina, or cellulose.

The electrical heating element is of stainless steel to enable the heating element to be formed by a stamping process.

Figure 2:
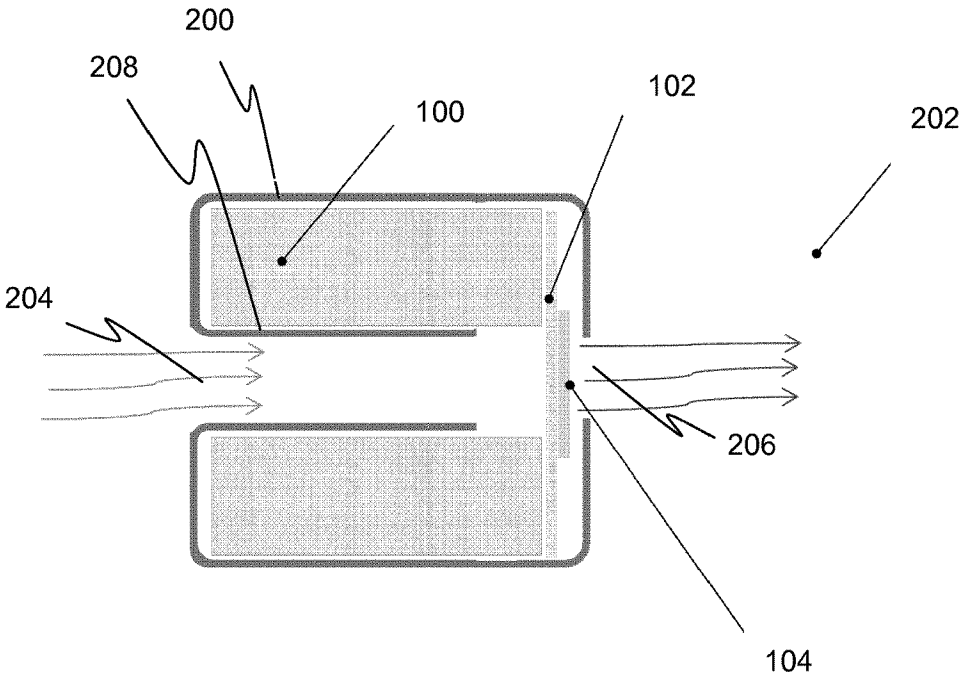
FIG. 2 shows a cross-sectional schematic view of a container according to the present invention.

The components shown in FIG. 1 are received in housing 200 of container 202, as shown in FIG. 2. The container further comprises an air inlet 204, and an air outlet 206. A substantially air impermeable tubular portion 208 is provided within the tubular element 100. The tubular portion 208 extends from the air inlet 204 towards the air outlet 206. The longitudinal length of the tubular portion 208 may be at least 50% of the longitudinal length of the tubular element 100, but in a preferred example the longitudinal length is at least about 80%. The electrical contacts 106 and 108 (not shown in FIG. 2) are provided on the external end face of the housing at the air inlet 204 end.

As can be seen, in use, an airflow pathway extends from the air inlet 204 to the air outlet 206 via the tubular portion 208 and through the membrane 102. The operation of the container in an aerosol-generating device is described in detail below.

Figure 3:
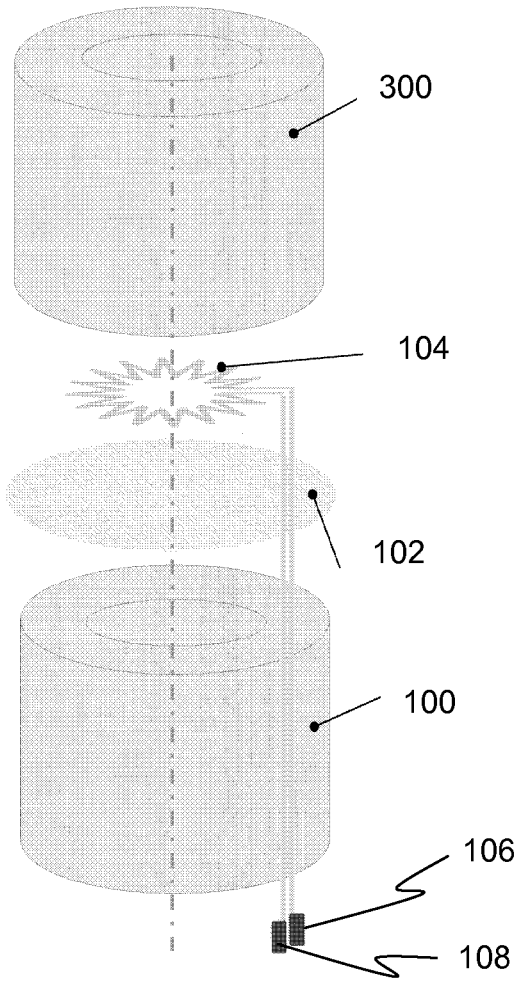
FIG. 3 shows an exploded view of the internal components of an alternative container according to the present invention.

FIG. 3 shows an exploded view of the internal components of an alternative container. Throughout the description, like reference numerals refer to like components. The example in FIG. 3 comprises the internal components as shown in FIG. 1, however as can be seen a further tubular element 300 for receiving a liquid aerosol-generating substrate is provided adjacent the membrane 102. The internal components shown in FIG. 3 may be incorporated into a similar housing to that shown in FIG. 2. The longitudinal length of the tubular elements 100 and 300 may be the same as shown in this example. Alternatively, for example when the tubular element 100 comprises a different liquid to the tubular element 300, the longitudinal length of each element 100, 300 may be different. For example, when the tubular element 300 comprises a flavourant, the longitudinal length of the tubular element 300 may be less than the longitudinal length of the tubular element 100.

Figure 4:
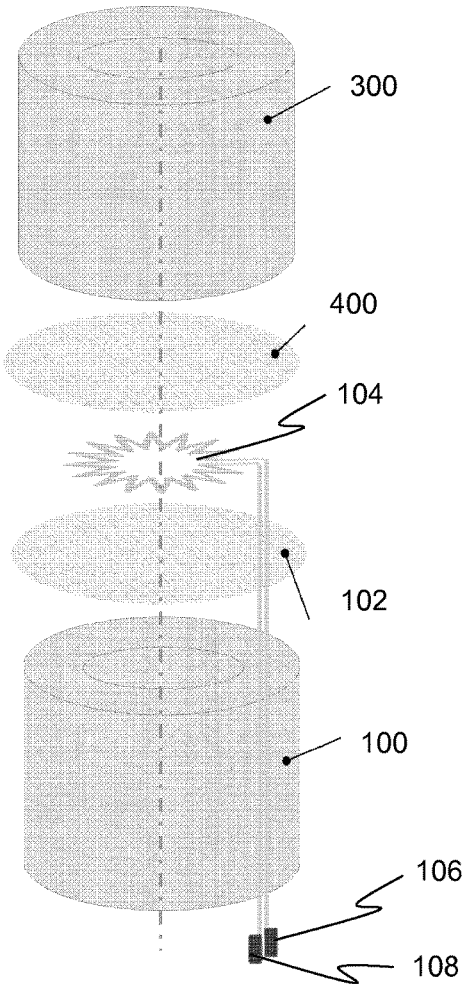
FIG. 4 shows an exploded view of the internal components of a further alternative container according to the present invention.

FIG. 4 shows an exploded view of the internal components of a further alternative container. The example shown in FIG. 4 is similar to that shown in FIG. 3, except a further capillary wick membrane 400 is provided. The further membrane 400 is arranged to form a laminate with the heater 104 and the membrane 102.

Figure 5:
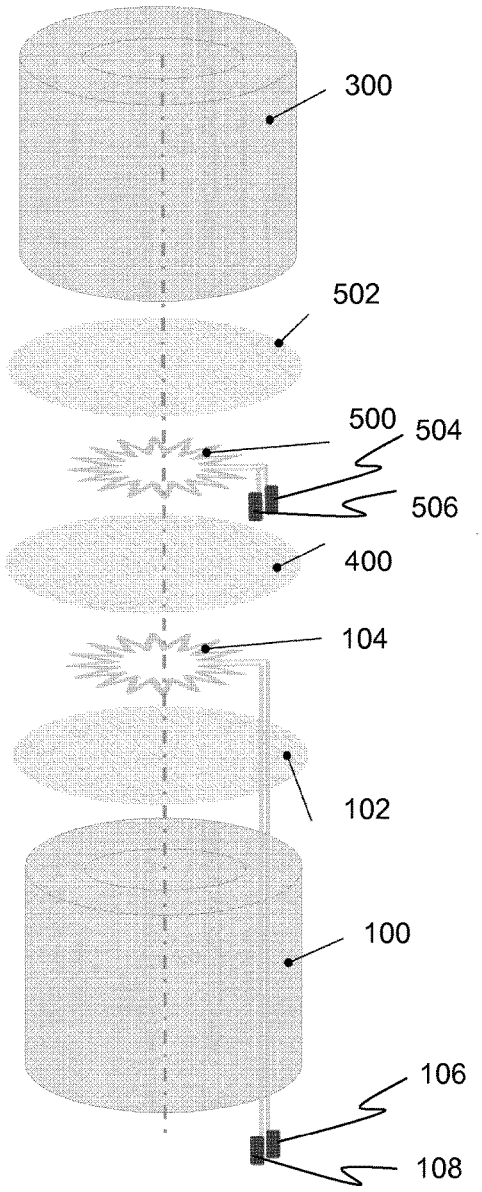
FIG. 5 shows an exploded view of the internal components of a yet further alternative container according to the present invention.

A yet further example is provided in FIG. 5, where a further heating element 500 and a further capillary wick membrane 502 are provided. The further heating element 500 and the membrane 502 are arranged to form a laminate comprising a layer of the membrane 102, a layer of the heating element 104, a layer of the membrane 400, a layer of the heating element 500 and a layer of the membrane 502. The heating element 500 comprises electrical contacts 504 and 506. The electrical contacts 504 and 506 are electrically coupled to the corresponding legs of the heating element 104. In this way during use, the electrical power received via the electrical contacts 106 and 108 heats both the heating element 104 and the heating element 500.

Figure 6:
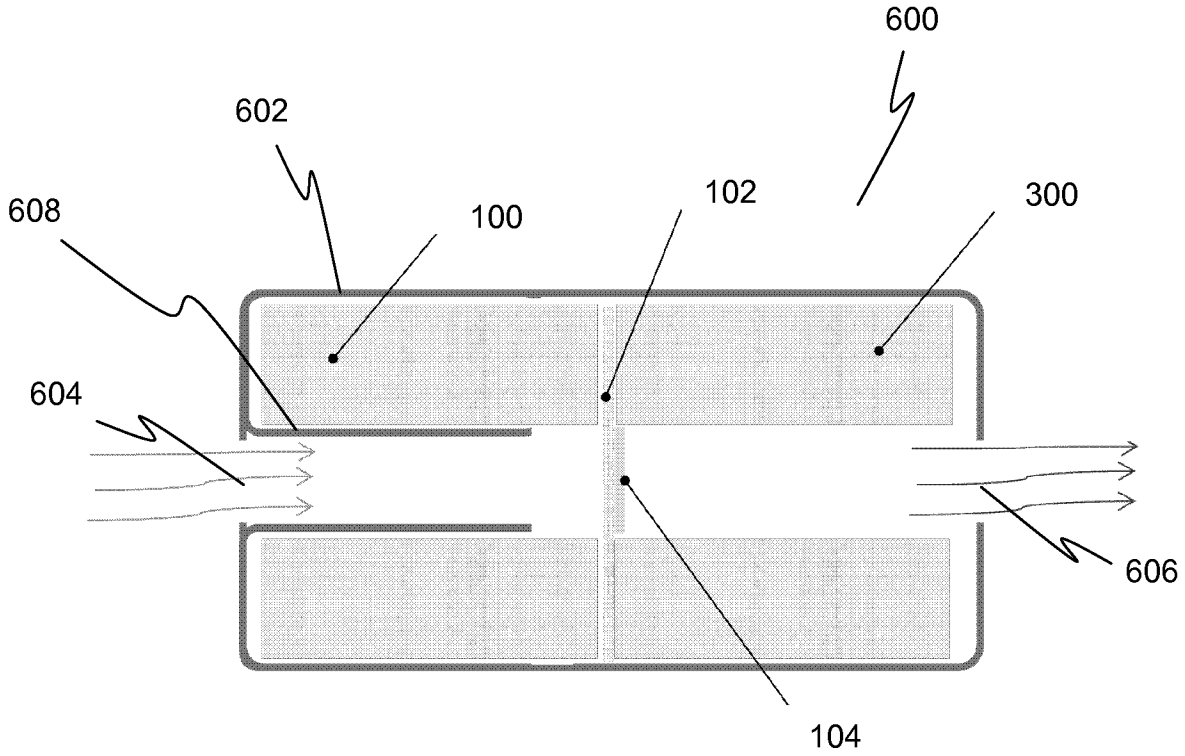
FIG. 6 shows a cross-sectional schematic view of an alternative container according to the present invention.

FIG. 6 shows a cross-sectional schematic view of a container 600 comprising the components shown in FIG. 3. The container comprises a housing 602, an air inlet 604, and an air outlet 606. A substantially air impermeable tubular portion 608 is provided within the tubular element 100. The tubular portion 608 extends from the air inlet 604 towards the air outlet 606. The longitudinal length of the tubular portion 608 may be at least 50% of the longitudinal length of the tubular element 100, but in a preferred example the longitudinal length is at least about 80%. The electrical contacts 106 and 108 (not shown in FIG. 2) are provided on the external end face of the housing at the air inlet 604 end.

As can be seen, in use, an airflow pathway extends from the air inlet 604 to the air outlet 606 via the tubular portion 608, through the membrane 102, and through the tubular portion 300. The operation of the container in an aerosol-generating device is described in detail below.

Figure 7:
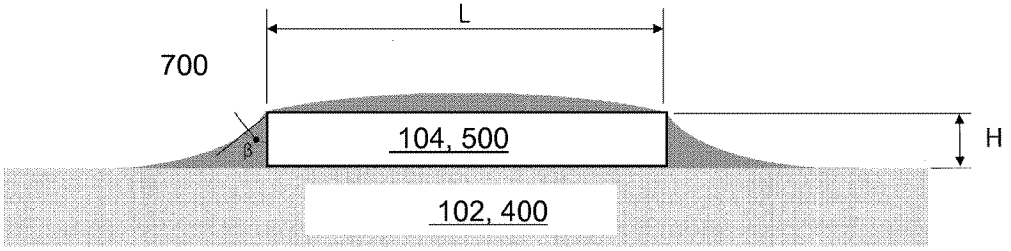
FIG. 7 shows a cross-sectional view of a portion of a membrane and heater arrangement according to the present invention.

As shown in FIG. 7, which is a cross-sectional view of the heating element 104, 500, and membrane 102, 400, the electrically resistive material used to form the heating element 104, 500 has an elongate cross-sectional shape. The elongate cross-sectional shape in this example is rectangular. As can be seen, a meniscus 700 is formed on the edges of the heating In this way, the volume of liquid adjacent the heating element is increased as compared to a conventional heating element, and thus the liquid may be vapourised more efficiently.

Figure 8:
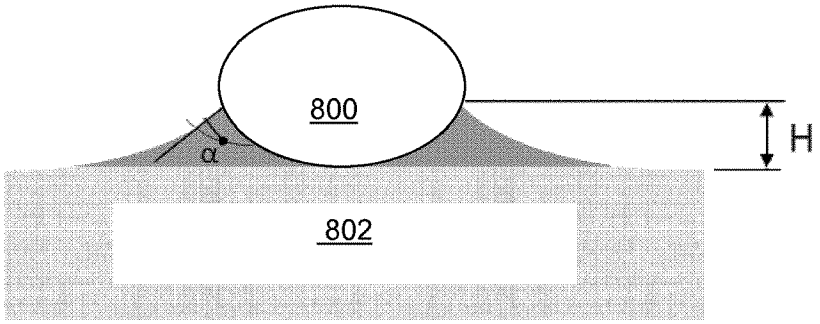
FIG. 8 shows a cross-sectional view of a portion of a membrane having a conventional heater arrangement of the prior art.

A conventional heating element 800 is shown in FIG. 8. As can be see, a meniscus 802 is only formed at the side of the heating element and not on the exposed surface.

Figure 9:
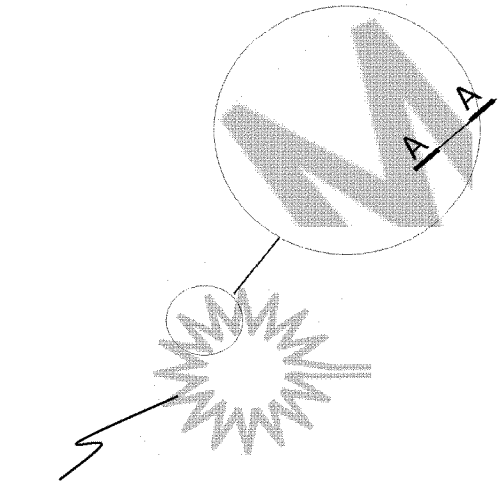
FIG. 9 shows an electrical heater according to the present invention.

FIG. 9 shows the heating element 104, 500 and the cross-section A-A shown in FIG. 7.

The electrical heating element 104, 500 is formed by stamping an electrically resistive material, such as stainless steel, and then adhering that stamped heating element to the membrane.

Figure 10:
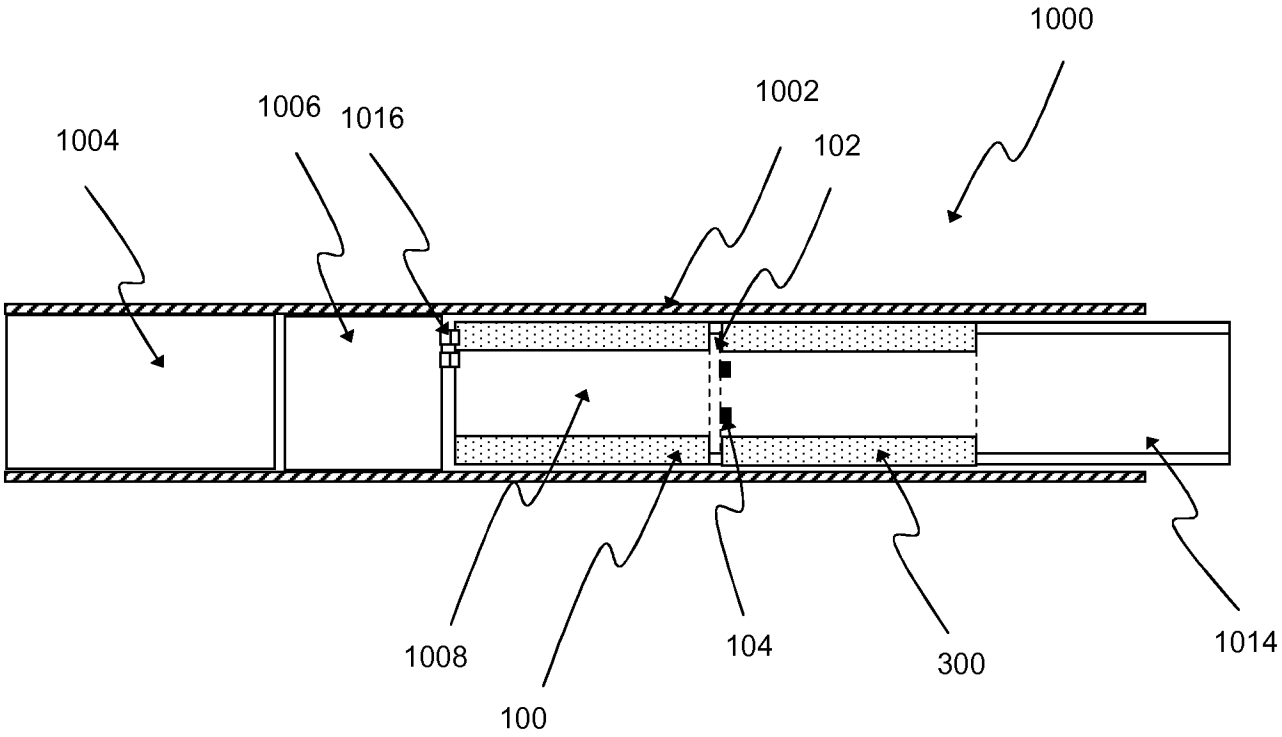
FIG. 10 shows a cross-sectional schematic view of an aerosol-generating device according to the present invention.

FIG. 10 shows a cross-sectional view of an aerosol-generating device 1000 configured for use with a container as described above. The device comprises an outer housing 1002 having a power supply 1004, control circuitry 1006, and a cavity 1008 for receiving a container 202, 600 as described above. The housing 1002 is formed from a thermoplastic, such as polypropylene. The device 1000 further comprises electrical contacts 1010 provided at the end of the cavity 1008. The electrical contacts are configured to connect to the electrical contacts of the container so that electrical power can be provided from the power supply 1004 to the heating element 104, 500. The electrical contacts 1016 may be substantially continuous concentric rings so that the container may be inserted in any rotational orientation, or they may be single contacts, the container being keyed to the cavity such that it may only be inserted in one rotational orientation to ensure that the electrical connections are made.

The housing also comprises at least one air inlet 1012 which is in fluid communication with the cavity 1008. The at least one air inlet may be a plurality of air inlets arranged around the circumference of the housing, in the form of perforations.

In use, the user inserts the container 202, 600 into the cavity 1008. The electrical connections are made, and the user can activate the device by either activating a switch (not shown), or by puffing on the device. Where the device is activated by puffing, a puff sensor, such as a microphone, or measurement of the resistance or resistivity of the heating element is provided. On detection of the puff, power, or further power as the case may be, is provided to the heating element to vapourise the liquid aerosol-generating substrate which is subsequently inhaled by the user. The control circuitry 1006 is configured to control the power provided to the heating element such that the temperature of the heating element is maintained at the operation temperature.

As the user puffs on the device air is drawn into the device through the air inlet 1012, the air then proceeds along the airflow pathway as described above. As the air passes through the air permeable membrane 102, 400, 502, the vapourised aerosol-generating substrate is entrained. As can be seen, in this example, the container 202, 600 is further provided with a mouthpiece 1014, in fluid communication with the air outlet of the tubular element 300, and thus through which the aerosol is inhaled by the user.

In the above examples, the aerosol-generating device is an electrical smoking device and the liquid aerosol-generating substrate retained on the tubular elements 100, 300 comprises nicotine and an aerosol-former such as glycerine or propylene glycol.

The manufacturing process of the heating element and the membrane is described with reference to FIG. 11.

Figure 11A:
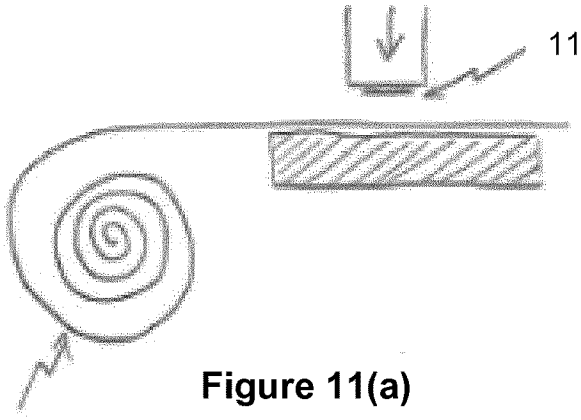
FIG. 11 shows the manufacturing process of the heating element and the membrane.
Figure 11B:
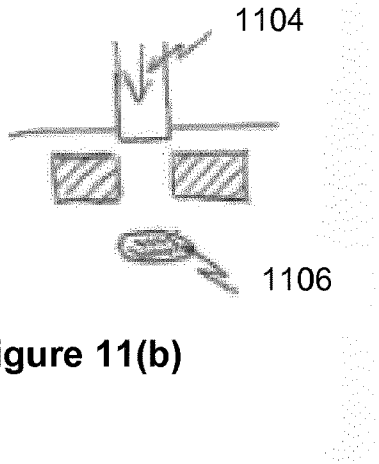
Figure 11C:
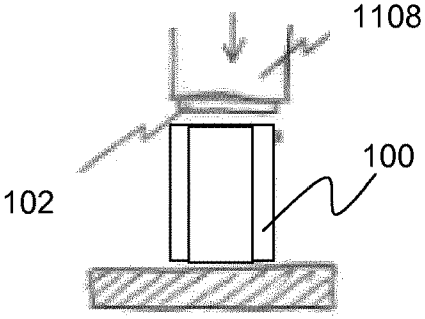

FIG. 11(*a*) shows a bobbin 1100 comprising a web of capillary wick membrane material. The capillary wick membrane material is configured to receive a pre-stamped heating element 1102. The heating element may be stamped using a suitable die and punch arrangement. Thus in the process step shown in FIG. 11(*a*), a substantially continuous web of capillary wick membrane material having multiple heating elements is formed.

FIG. 11(*b*) shows the next step in the process. The web of capillary wick membrane material is cut, using a punch 1104 and die, into individual disks 1106 each having a heating element. The disks have a diameter substantially equal to the diameter of the tubular element.

FIG. 11(*c*) shows the membrane and heating element disk 102 being applied to the tubular element 100 in preparation for being inserted into the container. The tubular element is then inserted into the casing of a container and liquid is added to the tubular element.

Other container designs incorporating a heater in accordance with this disclosure can now be conceived by one of ordinary skill in the art.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A container for an aerosol-generating substrate, comprising:

a casing having at least one air inlet and at least one air outlet;

a tubular liquid retention element, configured to sorb the aerosol-generating substrate; and an air permeable capillary wick membrane comprising at least one electrical heater, wherein the air permeable capillary wick membrane is disposed on an end face of the tubular liquid retention element, such that an airflow pathway is provided from the at least one air inlet through a portion of the air permeable capillary wick membrane to the at least one air outlet.

2. The container according to claim 1, wherein the at least one electrical heater is disposed on the portion of the air permeable capillary wick membrane within the airflow pathway.

3. The container according to claim 1, further comprising a tubular element disposed within the tubular liquid retention element, and extending from the at least one air inlet towards the air permeable capillary wick membrane.

4. The container according to claim 1, wherein the air permeable capillary wick membrane is disposed at a downstream end of the tubular liquid retention element.

5. The container according to claim 1, further comprising a further tubular liquid retention element disposed adjacent an end of the tubular liquid retention element such that the air permeable capillary wick membrane is disposed between the tubular liquid retention element and the further tubular liquid retention element.

6. The container according to claim 1, further comprising a further air permeable capillary wick membrane disposed adjacent the at least one electrical heater, such that a laminate is formed with the at least one electrical heater encapsulated within the air permeable capillary wick membrane and the further air permeable capillary wick membrane.

7. The container according to claim 6, further comprising a further electrical heater disposed on the further air permeable capillary wick membrane.

8. The container according to claim 7, wherein the further electrical heater is electrically coupled to the at least one electrical heater.

9. The container according to claim 7, further comprising a third air permeable capillary wick membrane disposed adjacent the further electrical heater, such that a laminate is formed with the further electrical heater encapsulated within the further air permeable capillary wick membrane and the third air permeable capillary wick membrane.

10. The container according to claim 1, wherein the at least one electrical heater has an elongate cross-sectional profile.

11. The container according to claim 1, wherein the at least one electrical heater has a rectangular cross-sectional profile.

12. The container according to claim 1, wherein the at least one electrical heater comprises two electrical contacts extending from the at least one electrical heater to an external surface of the casing.

13. The container according to claim 12, wherein the two electrical contacts extend to an external end surface of the casing.

14. An electrically heated aerosol-generating device, comprising:

a power supply;

a cavity configured to receive a container containing an aerosol-generating substrate, the container comprising:

a casing having at least one air inlet and at least one air outlet;

a tubular liquid retention element, configured to sorb the aerosol-generating substrate; and an air permeable capillary wick membrane comprising at least one electrical heater, wherein the air permeable capillary wick membrane is disposed on an end face of the tubular liquid retention element, such that an airflow pathway is provided from the at least one air inlet through a portion of the air permeable capillary wick membrane to the at least one air outlet, and electrical contacts connected to the power supply and configured to couple the power supply to the at least one electrical heater of the container, wherein an air inlet is configured to be coupled to the at least one air inlet of the container when the container is received in the cavity.

* * * * *